US006123212A

United States Patent [19]

Russell et al.

[11] Patent Number: 6,123,212

[45] Date of Patent: Sep. 26, 2000

[54] PLASTIC CLOSURE WITH ROTATION-INHIBITING PROJECTIONS

[75] Inventors: Mark N. Russell; Mark A. Powell, both of Crawfordsville, Ind.

[73] Assignee: Alcoa Closure Systems International, Crawfordsville, Ind.

[21] Appl. No.: 09/384,824

[22] Filed: Aug. 27, 1999

[51] Int. Cl.[7] ..... B65D 41/04

[52] U.S. Cl. ..... 215/330; 215/44; 215/307

[58] Field of Search ..... 215/44, 307, 330

[56] References Cited

U.S. PATENT DOCUMENTS

| | | | |
|---|---|---|---|
| 2,162,880 | 6/1939 | Brown . | |
| 3,147,876 | 9/1964 | Lepore . | |
| 3,295,708 | 1/1967 | Wathen, Jr. | 215/330 |
| 3,405,831 | 10/1968 | Hudson . | |
| 3,620,400 | 11/1971 | Braun | 215/330 |
| 3,682,345 | 8/1972 | Baugh | 215/330 |
| 3,741,421 | 6/1973 | Wittwer . | |
| 3,987,921 | 10/1976 | Aichinger . | |
| 4,007,848 | 2/1977 | Snyder . | |
| 4,382,521 | 5/1983 | Ostrowsky . | |
| 4,427,126 | 1/1984 | Ostrowsky . | |
| 4,456,137 | 6/1984 | Lyman . | |
| 4,461,394 | 7/1984 | Sendel et al. | 215/330 |
| 4,497,765 | 2/1985 | Wilde et al. . | |
| 4,674,643 | 6/1987 | Wilde et al. . | |
| 4,697,715 | 10/1987 | Beruvides | 215/330 |
| 4,738,370 | 4/1988 | Urmston et al. . | |
| 4,747,502 | 5/1988 | Luenser . | |
| 4,978,017 | 12/1990 | McBride . | |
| 5,184,741 | 2/1993 | Chevassus et al. | 215/331 |
| 5,197,620 | 3/1993 | Gregory . | |
| 5,205,426 | 4/1993 | McBride et al. . | |
| 5,366,774 | 11/1994 | Pinto et al. . | |
| 5,676,270 | 10/1997 | Roberts | 215/330 |
| 5,884,790 | 3/1999 | Seidita . | |

*Primary Examiner*—Stephen K. Cronin
*Attorney, Agent, or Firm*—Rockey Milnamow & Katz LTD

[57] ABSTRACT

A closure for a container having carbonated or otherwise pressurized contents includes a top wall portion, and an annular depending skirt portion. An internal thread formation mates with a like thread formation of an associated container. To facilitate gas venting during closure removal, the container includes a plurality of axially extending vent grooves. Release of gas pressure during closure removal is facilitated by providing the closure with at least one, and preferably a plurality of rotation-inhibiting projections positioned adjacent to the internal thread formation. The projections interferingly engage with the vent grooves of the associated container, thus providing increasing frictional drag during closure removal to permit dissipation of gas pressure from within the container.

22 Claims, 3 Drawing Sheets

PLASTIC CLOSURE WITH ROTATION-INHIBITING PROJECTIONS

TECHNICAL FIELD

The present invention relates generally to threaded plastic closures for containers, and more particularly to a threaded plastic closure for a container having one or more rotation-inhibiting projections which act in cooperation with vent grooves of an associated container to facilitate release of gas pressure from within the container during closure removal.

BACKGROUND OF THE INVENTION

Threaded plastic closures for containers, such as for carbonated beverages and the like, have found very widespread acceptance in the marketplace. Closures of this nature typically include a molded plastic closure cap having a top wall portion, and a depending cylindrical skirt portion. The skirt portion includes an internal thread formation configured for threaded cooperation with a like thread formation on an associated container. The desired sealing with the container can be achieved by providing the closure with a sealing liner positioned generally adjacent the top wall portion. Closures of this type which have proven to be particularly commercially successful are disclosed in U.S. Pat. No. 4,343,754, No. 4,378,893, and No. 4,497,765, all of which are hereby incorporated by reference. For many applications, it is desirable to configure such closures for tamper-indication, such as in accordance with the teachings of the above-referenced U.S. Pat. No. 4,497,765, or in accordance with the teachings of U.S. Pat. No. 4,938,370, No. 4,978,017, and No. 5,004,112, all hereby incorporated by reference.

As noted, closures of the above type have proven to be very commercially successful for use on containers having carbonated contents. As such, closures of this type are typically configured to facilitate venting and release of gas pressure from within the container during closure removal. In particular, it is desirable to release such gas pressure from within the container prior to disengagement of the closure thread formation from the threads provided on the neck portion of the associated container.

While it has long been recognized that gas can flow from within the container, during closure removal, by flow along the mating thread formations, other arrangements have been employed to facilitate gas flow. Such arrangements include the provision of vent grooves in the container, which grooves are generally axially oriented, and traverse and substantially interrupt the container thread formation. Similarly, the threads of a closure can be interrupted to provide increased gas flow, with the provision of axially extending vent grooves in the side wall of closures also known.

Experience has shown that use of interrupted threads and/of vent grooves in plastic closures can sometimes detract from optimum closure performance. While efforts have been made in the past to maximize the cross-sectional area of such closure vent passages, it is desirable to maximize the length of each individual closure thread between the vents to maximize axial strength and hoop strength of the closure. Additionally, short thread segments have been shown to contribute to misapplication of closures during high-speed bottling, by contributing to "cocking" or misaligned application of closures. It is also believed to be desirable to limit the depth of such closure vent passages, to thereby minimize any decrease in strength of the closure in such regions. It is believed that reduction in the closure wall thickness in the vent locations can result in the formation of "knit/weld lines" during the closure molding process. Molten plastic material naturally tends to seek the flow path of least resistance as the mold space is filled during the closure molding process. As a consequence, areas in which the closure wall thickness is reduced (i.e., at closure vent passages) which are bordered by areas of increased wall thickness may not fill as quickly as the thicker adjacent regions. The resulting knit/weld lines formed axially in the region of the vent passages naturally exhibit reduced strength, and can undesirably detract from the impact resistance of such closures.

In light of the above, it is believed that it is desirable to minimize the number of vent passages provided in a threaded plastic closure, while preferably also maximizing the length of individual thread segments between vent passages. In this regard, it has been known in the prior art to provide plastic closures with projections on or adjacent to the thread formation, which projections act to inhibit relative rotation of the closure with respect to the container. These projections, sometimes referred to as "speed bumps", can coact with the thread formation of the container to inhibit relative rotation, and may further inhibit such rotation by coaction with axially extending vent grooves of the container. Inhibiting closure rotation during removal facilitates venting of gas pressure from within the container prior to disengagement of the mating thread formations.

While such rotation-inhibiting projections are known, their use can also complicate closure application. The engagement of such a projection with the associated container thread during high-speed application can also undesirably result in "cocking" of closures, thus detracting from efficient high-speed bottling.

The present invention is directed to a closure having an improved arrangement of rotation-inhibiting projections which facilitate release of gas pressure within an associated container prior to disengagement of the cooperating closure and container thread formations.

SUMMARY OF THE INVENTION

A plastic closure embodying the principles of the present invention includes at least one rotation-inhibiting projection associated with a helical thread formation of the closure. Notably, the projection is asymmetrically configured relative to a radius of the closure extending therethrough, and thereby defines and presents a guide surface and an interference surface. The guide surface is oriented in a direction toward a thread start of the thread formation, and facilitates guided application of the closure onto a container during high-speed application. In distinction, the interference surface is configured to promote interfering engagement with the associated container, in particular, vent grooves defined by the container, thus inhibiting rotation of the closure relative to the container during removal. This facilitates release of gas pressure from within the container prior to disengagement of the closure threads from the thread formation of the container.

In accordance with the illustrated embodiment, the present closure includes a closure cap including a top wall portion, and a cylindrical skirt portion depending from the top wall portion. The cylindrical skirt portion includes an internal thread formation extending circumferentially of the closure at least 360°. In the preferred form, the thread formation extends circumferentially of the closure more than 360°, to thereby at least partially overlap itself. The thread formation includes a thread start at an end thereof spaced furthest from the top wall portion of the closure cap. The thread start is that portion of the thread first moved into engagement with the thread formation of an associated container during high-speed application.

The present closure includes at least one, and preferably a plurality, of rotation-inhibiting projections provided on the inside surface of the skirt portion adjacent the thread formation for engagement with a mating thread formation on the associated container. A rotation-inhibiting projection is positioned adjacent the thread formation in circumferentially spaced relationship to the thread start. Significantly, the projection is asymmetrically configured relative to a radius of the closure through the projection. By this configuration, the projection defines a guide surface oriented in a direction of the thread formation toward the thread start, and an interference surface oriented in a direction of the thread formation away from the thread start. The interference surface of the projection is oriented at an angle between about 0° and 45° relative to the radius of the closure extending through the projection. In contrast, the guide surface is oriented at an angle between about 70° and 90° relative to the radius through the projection, and thus provides a tapered "ramp surface" to facilitate high-speed application by smoothly engaging the container thread. By this arrangement, the interference surface defines a more abrupt surface for engagement with the associated container during closure removal. In particular, it is contemplated that the interference surface of each projection interferingly engage the axial vent grooves of the container during closure removal where the grooves traverse the container thread formation. A ratchet-like action is thus created as the closure is removed from the container, with each rotation-inhibiting projection sequentially engaging the vent grooves of the associated container.

In order to minimize misalignment of closures during high-speed application, it is preferred that the rotation-inhibiting projection positioned closest to the thread start of the closure thread formation be spaced from the thread start between about 20° and 40° relative to the circumference of the closure. In the preferred form, including a plurality of rotation-inhibiting projections, spacing between the projections is selected to optimize thread performance. In particular, the one of the rotation-inhibiting projections positioned along the extent of the thread formation closest to the thread start comprises a primary projection. In contrast, further ones of the rotation-inhibiting projections are provided in the form of at least one secondary projection. At least one or more secondary projection is positioned symmetrically with respect to a portion of the closure diametrically opposite of the primary projection, with the preferred embodiment including a single secondary projection positioned diametrically opposite of, and thus in symmetry with, the primary projection of the closure. In an alternate embodiment, including a pair of secondary projections, such secondary projections are positioned symmetrically with respect to the portion of the closure diametrically opposite of the primary projection. In this embodiment, each of the secondary projections is positioned between about 20° and 40° relative to the portion of the closure diametrically opposite the primary projection. This arrangement of the projections provides a centering effect during closure application, which tends to desirably maintain the closure in centered, aligned relationship with the associated container.

Other features and advantages of the present invention will become readily apparent from the following detailed description, the accompanying drawings, and the appended claims.

DETAILED DESCRIPTION

Figure 1:
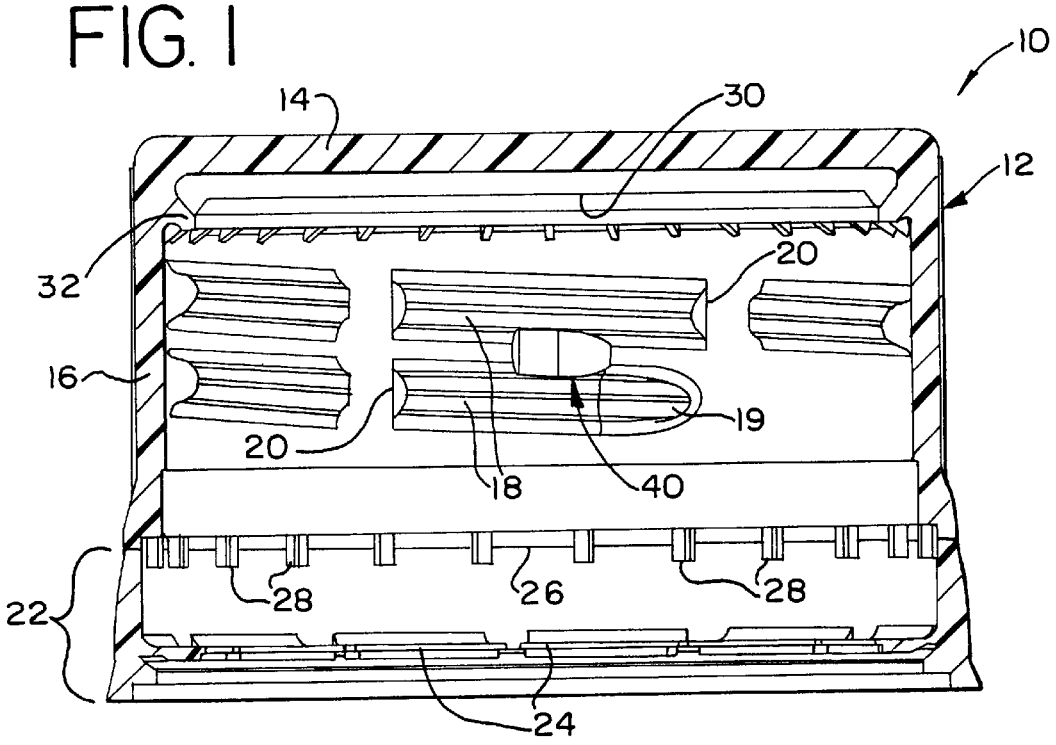
FIG. 1 is a cross-sectional view illustrating a plastic closure having rotation-inhibiting projections embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference to FIG. 1, therein is illustrated a plastic closure 10 having rotation-inhibiting projections embodying the principles of the present invention. This type of closure, sometimes referred to as a "composite closure" by virtue of its formation with an outer shell or cap, and an inner sealing liner, has proven to be very well-suited for use on containers having carbonated or otherwise pressurized contents to form a package therewith.

Closure 10 includes an outer molded closure cap or shell 12 having a top wall portion 14, and a depending cylindrical skirt portion 16. The skirt portion 16 includes an internal, helical thread formation 18. In the illustrated embodiment, thread formation 18 is shown in a discontinuous configuration, comprising plural thread segments, with the thread formation traversed by generally axially extending vent grooves or passages 20. Vent grooves 20 facilitate release of gas pressure from within a container during removal of the closure therefrom, with release and equalization of gas pressure preferably effected prior to disengagement of thread formation 18 from the cooperating thread formation of the associated container. Thread formation 18 preferably extends about the closure at least 360°, and preferably more than 360° so that the thread formation overlaps itself. Typically, thread formation 18 extends approximately 540° about the interior of the skirt portion 16 and thus, the thread formation overlaps itself along approximately one-half of the extent of the thread formation.

For purposes of the present disclosure, reference will be made to the thread start, designated 19, the portion of the thread formation 18 which is first moved into engagement with the threads in an associated container during application of the closure. The thread start is the portion of the thread formation 18 positioned furthest from top wall portion 14.

Other features of closure 10 will be recognized by those familiar with the art. The closure 10 is configured for tamper-indication, and to this end, includes an annular pilfer band 22 depending from skirt portion 16. The pilfer band 22 includes a plurality of circumferentially spaced, inwardly-extending flexible projections 24 which are configured for cooperative interengagement with the associated container.

The pilfer band 22 is distinguished from the skirt portion 16 by a score line 26 which extends partially or completely about the closure cap. The pilfer band 22 is at least partially detachably connected to the skirt portion 16 by the provision of a plurality of circumferentially spaced frangible ribs 28 which extend between the inside surfaces of the skirt portion 16 and the pilfer band, generally spanning the score line 26. The interaction of projections 24 with an associated container during closure removal acts to fracture the frangible ribs 28, thus partially or completely separating the pilfer band 22 from the skirt portion 16. Readily visually discernable evidence of opening is thus provided.

In the illustrated embodiment, the closure 10 includes a sealing liner 30 positioned adjacent the inside surface of the top wall portion 14. An annular lip or shoulder 32 extends generally inwardly from the skirt portion 16 to facilitate formation of the liner 30 within the closure cap by compression molding.

Figure 2:
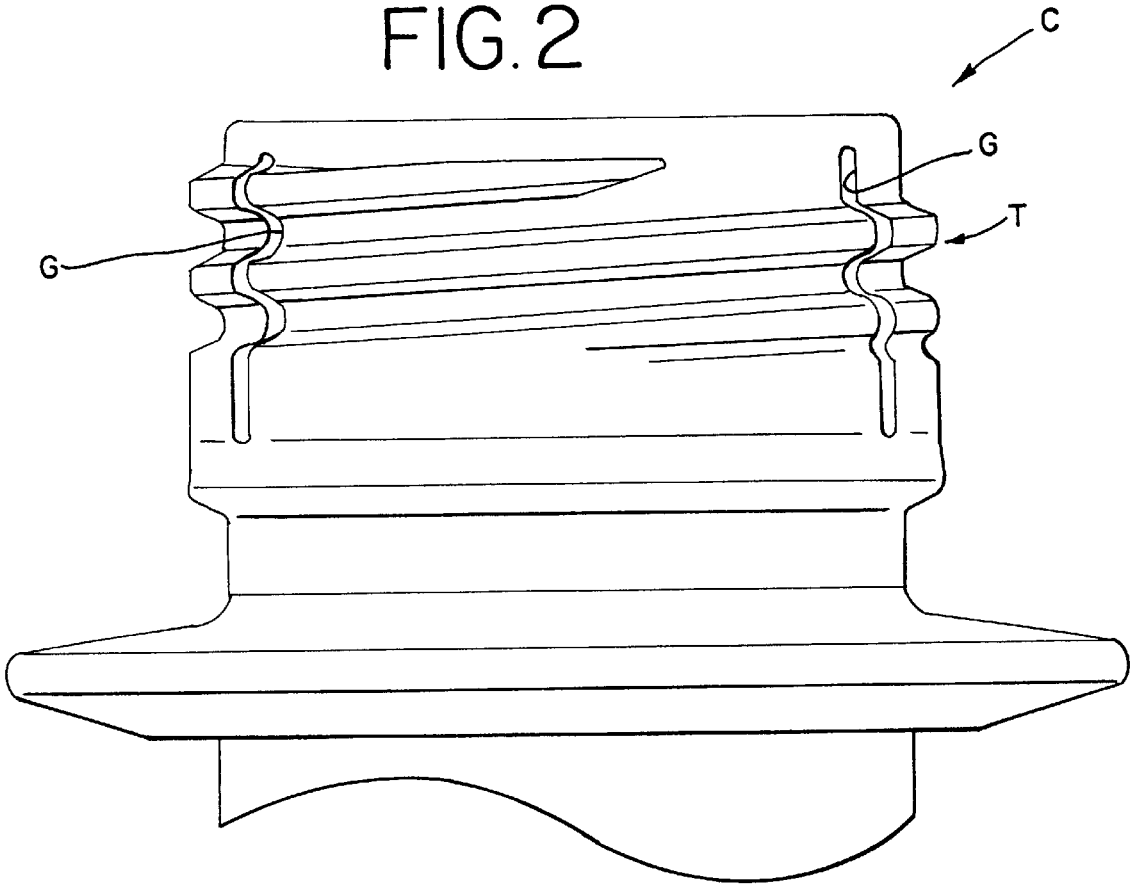
FIG. 2 is a fragmentary, elevational view of the threaded neck portion of a container of the type with which the present closure is suited for use.

In accordance with the present invention, the present closure is configured to facilitate venting and release of gas pressure from within an associated container, particularly a container having carbonated contents of the like. Typically, a container of this nature is configured in accordance with the illustrated container C, shown in FIG. 2, including a threaded neck portion including a thread formation T configured to mate with the thread formation 18 of the closure 10. To facilitate release of gas pressure from within such a container, the neck portion of the container includes at least one, and typically a plurality (i.e., four) of axially extending vent grooves G formed in the neck portion of the container, traversing the container thread formation T. These types of vent grooves facilitate release of gas pressure from within the container during closure removal by providing a plurality of flow paths which extend from the region of the sealing liner 30 of the closure downwardly to the lower free edge of the closure pilfer band. The vent grooves G are formed to extend into the container neck such that the grooves G are positioned inwardly of the thread formation 18 of the closure when the closure is positioned on the container.

In accordance with the present invention, closure 10 includes a plurality of rotation-inhibiting projections configured for cooperative, interengagement with the vent grooves G of the associated container C. The provision of these projections, as will be further described, facilitates venting and release of gas pressure from within the container C during closure removal, prior to disengagement of closure thread 18 from container thread T. The configuration and placement of the rotation-inhibiting projections have been specifically selected to provide the desired cooperation with the vent grooves G, while at the same time facilitating closure application and providing desired closure performance.

The object of providing one or more rotation-inhibiting projections is to increase frictional drag between the closure 10 and the associated container C by creating radial interference between each of the projections and the vent grooves G of the container, in addition to the radial interference created with the container thread formation. The creation of this frictional drag helps to dissipate potential energy stored in the bottle head space during closure removal. The frictional dissipation of energy acts to limit the amount of head space energy converted to closure kinetic energy during opening.

At the same time, it is important to facilitate closure application during high-speed bottling. Thus, each of the rotation-inhibiting projections of the present invention is configured to not only include an interference surface, but also a guide surface which facilitates closure application. Thus, each projection is asymmetrically configured, relative to a radius extending through the respective projection.

Figure 3:
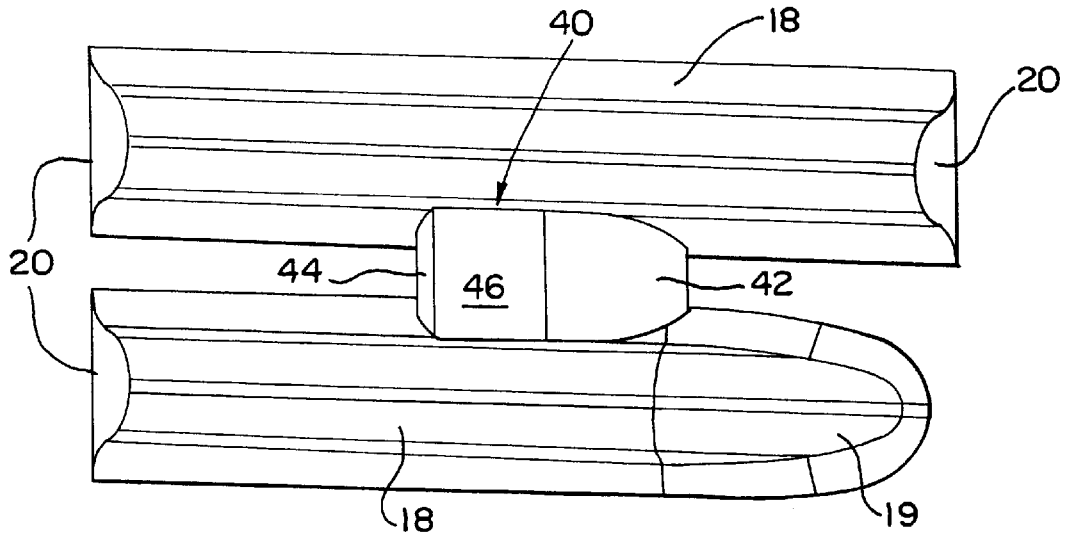
FIG. 3 is a perspective view illustrating a rotation-inhibiting projection in accordance with the present invention.
Figure 4:
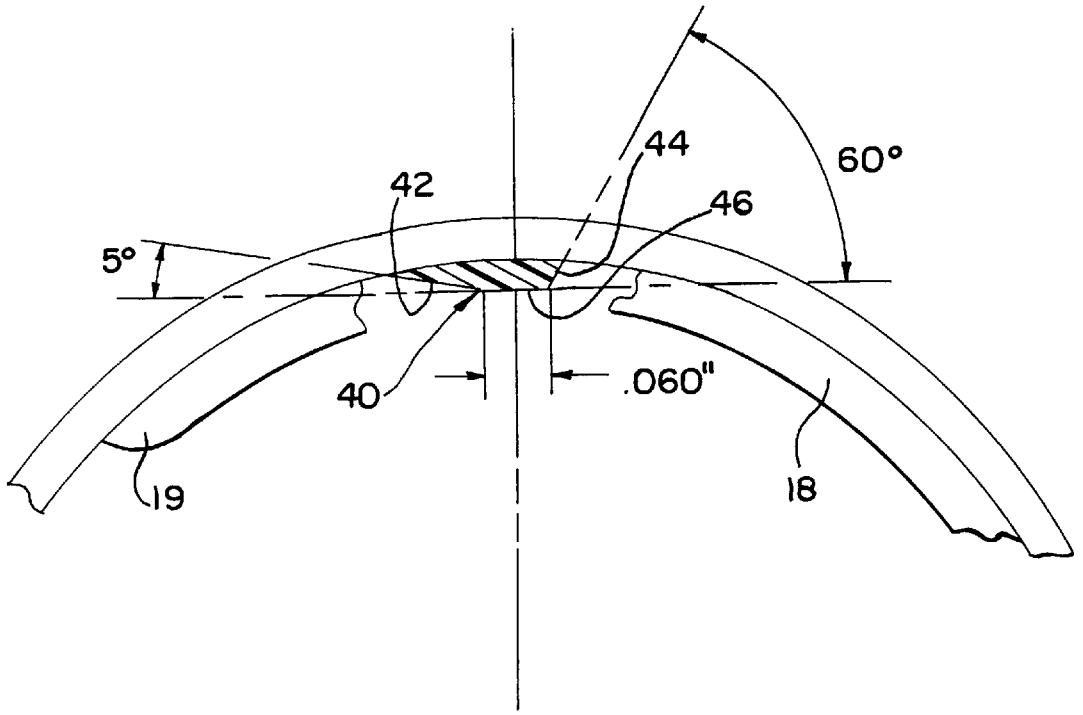
FIG. 4 is a cross-sectional view of the projection illustrated in FIG. 3.

A presently preferred configuration of the present rotation-inhibiting projections is shown in FIGS. 1, 3, and 4. In these illustrations, the rotation inhibiting projection is designated 40, and for purposes of the present discussion, will be considered a primary projection. Projection 40 is primary in the sense that it is positioned in most closely spaced relation to the thread start 19 of the closure thread 18, and thus is the first of the projections 40 to engage the associated container thread during application, and the last to disengage the container thread during closure removal. It will be observed that the closure is configured such that no interference projection or the like will come into engagement with the container thread formation T, during closure application, prior to engagement of the container thread with the projection 40.

As illustrated, the projection 40 includes a guide surface 42, an interference surface 44, and an intermediate surface 46 positioned between the guide and interference surfaces. On the one hand, it is desirable to position the primary projection 40 as close to thread start 19 as possible, since this positions the projection for interfering engagement with the container vent groove just prior to disengagement of the closure thread formation 18 from the container thread formation T. On balance, experience has shown that disposition of the primary projection 40 in too closely spaced relationship to the thread start 19 can contribute to misalignment and "cocking" of closures during high-speed application. Accordingly, the primary projection 40 is positioned between about 20° and 40° from the thread start 19, relative to the circumference of the closure. In a presently preferred embodiment, the primary projection 40 is positioned about 30° from the thread start. This arrangement assures engagement of the mating thread formations prior to engagement of the projection 40 with the container thread T.

With particular reference to FIG. 4, the preferred configuration of the projection 40 is illustrated. In order to maximize the frictional interengagement between the interference surface 44 and the vent groove of the container where it traverses the thread formation T, the interference surface is oriented in a direction of the thread formation away from the thread start 19. The interference surface is oriented at an angle between about 0° and 45° relative to a radius of the closure through the projection, with the interference surface 44 more preferably oriented at an angle between about 25° and 35° relative to the radius. The surface 44 is oriented 30° in the illustrated embodiment, and thus presents an abrupt change in the radial elevation of the projection.

In contrast, the guide surface 42 of the projection is oriented in a direction of the thread formation toward the thread start 19. The guide surface is preferably oriented at an angle between about 70° and 90° relative to a radius of the closure through the projection. Thus, it will be appreciated that each of the projections 40 is asymmetrically configured relative to a radius of the closure therethrough, with the guide surface 42 being oriented at an angle relative to a radius through the projection greater than an angle at which the interference surface 44 is oriented. In the illustrated embodiment, each of the guide surface 42, interference surface 44, and intermediate surface 46 are generally planar, but it will be understood that it is within the purview of the present invention to provide one or more rotation-inhibiting projections which are otherwise configured while keeping with the teachings disclosed herein.

As further illustrated in FIG. 4, each of the projections 40 has a radial dimension less than the height of the thread formation 18, with each projection having a typical radial dimension between about 0.020 inches and 0.040 inches. With this relative dimensioning, the intermediate surface 46 has a circumferential dimension of approximately 0.060 inches. While it will be understood that the specific dimensions of the projections can be varied while keeping with the principles disclosed herein, the illustrated embodiment of the projections has been found to provide the desired friction-increasing interference, while facilitating high-speed application of the closures to containers.

In the preferred form of the present invention, a plurality of rotation-inhibiting projections are provided. Thus, while the projection 40 positioned most closely to thread start 19 has been termed the primary projection, the closure 10 includes at least one secondary projection, designated 40'. The one or more secondary projections 40' are preferably configured in accordance with the above description of primary projection 40, with each of the secondary projections preferably being asymmetrical with respect to a respective closure radius extending therethrough, with each including a guide surface, an interference surface, and an intermediate surface therebetween.

Figure 5:
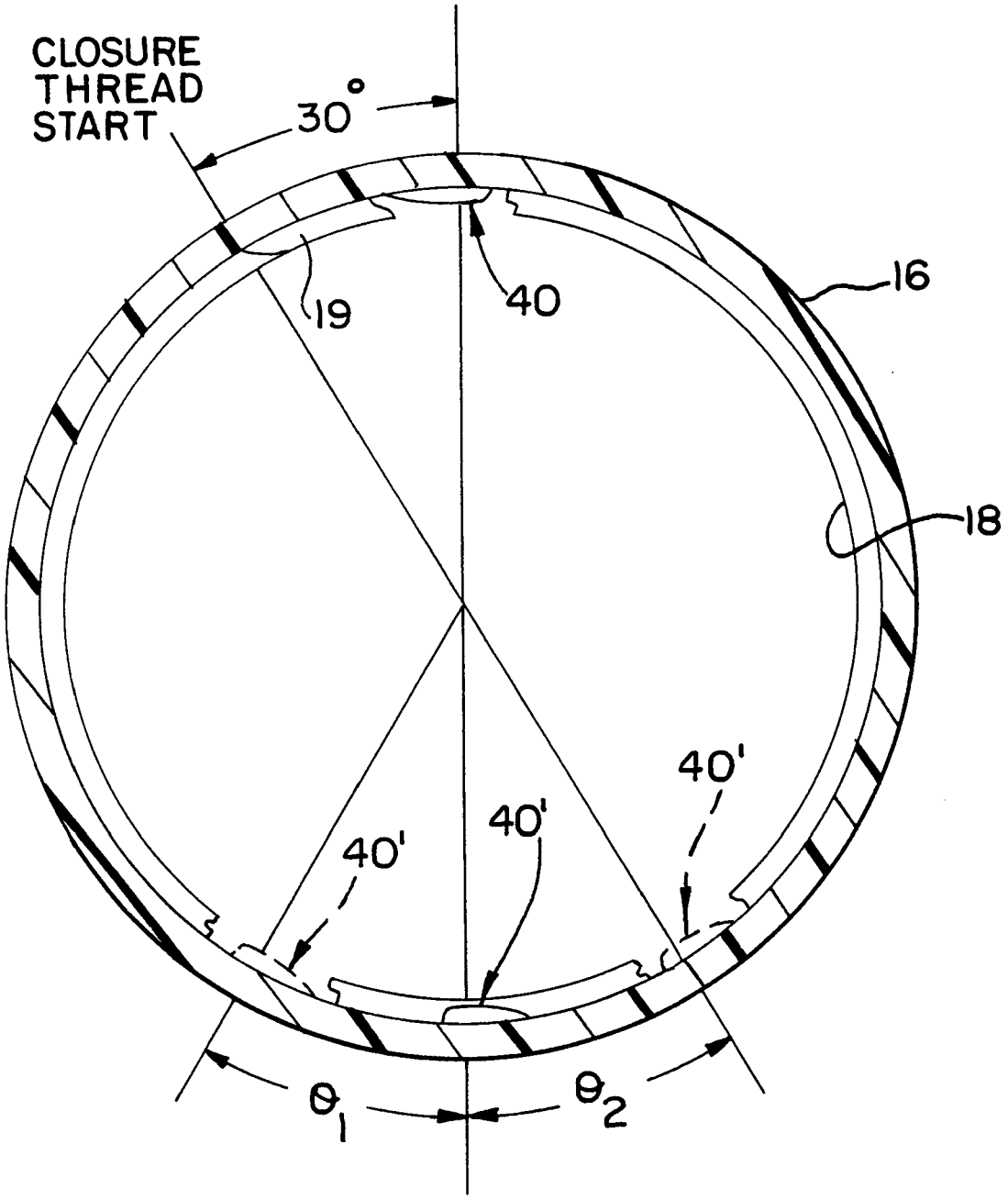
FIG. 5 is a diagrammatic, cross-section view illustrating positioning of plural rotation-inhibiting projections about the rotational axis of the present closure.

FIG. 5 illustrates the presently preferred configuration of a closure having rotation-inhibiting projections embodying the present invention. In the present closure, the internal thread formation 18 extends circumferentially of the closure at least 360°, and typically extends more than 360° to thereby at least partially overlap itself. Typically, the thread formation 18 extends 540°, and thus, overlaps itself throughout approximately 180°, thus presenting a portion within the thread formation which is a "double thread". In accordance with the illustrated embodiment, it is preferred that the primary projection 40 be positioned between overlapping portions of the thread formation 18, with FIG. 5 illustrating spacing of the primary projection 40 30° from the thread start 19 of the thread formation.

FIG. 5 illustrates the provision of at least one secondary projection 40'. It is presently preferred that a single projection 40' be positioned symmetrically with respect to a portion of the closure cap 12 diametrically opposite of the primary projection 40, as illustrated in FIG. 5. Positioning the rotation-inhibiting projections 40, 40' in symmetrical or centered relationship about the rotational axis of the closure desirably tends to maintain the thread formation 18 in engagement with the container throughout the circumference of the closure. In an alternate embodiment, a pair of secondary projections 40' are positioned symmetrically with respect to the diametrically opposite portion of the closure. This is illustrated in phantom in FIG. 5, where each of a pair of secondary projections 40' is positioned at a respective angle $\theta_1$, $\theta_2$ with respect to the portion of the closure skirt 16 diametrically opposite of the primary projection 40. In the illustrated alternate embodiment, each of the secondary projections 40' is positioned about 30° relative to the diametrically opposite portion of the closure, that is, each of $\theta_1$ and $\theta_2$ equals 30°. This arrangement maintains a general symmetry between the primary projection 40 and the secondary projections 40', thus facilitating alignment of the closure with the associated container.

Thus, the present closure includes a primary projection 40 spaced between about 20° to 40° from the thread start 19, and at least one secondary projection 40' spaced between about 180° and 240° from the thread start, with the single secondary projection 40' of the illustrated embodiment positioned diametrically opposite of primary projection 40. The closure may further include at least one further secondary projection 40' preferably spaced no further than about 250° from the thread start, with the plural secondary projections 40' positioned symmetrically relative to the portion of the closure diametrically opposite of primary projection 40.

The provision of rotation-inhibiting projections 40, 40' in accordance with the present invention has been found to desirably facilitate release of gas pressure from within the associated container, which affords greater flexibility in closure design. While previous constructions have included a plurality of the vent grooves or passages 20 in the closure cap, it is desirable to increase the length and strength of individual thread segments of the thread formation, thus suggesting the desirability of minimizing the number of vent passages, while also minimizing their size to maximize the size of thread segments. It is believed that frictional drag created by the projections 40, 40' can be sufficient to provide proper gas venting, as the projections "catch" the container vent grooves and allow more time for gas venting.

It is also believed to be desirable to reduce the depth of vent grooves or passages 20, which is also possible by the provision of the rotation-inhibiting projections 40, 40'. To the extent that such vent passages are provided, it is desirable that such passages not be configured to extend into the skirt portion 16 of the closure, i.e., not extend outwardly of the root diameter of the thread formation 18. Reducing the depth of such vent grooves is desirable in that it facilitates high-speed closure molding. Areas in which the closure wall thickness is reduced, by the provision of relatively deep vent passages, will not fill as quickly with molten plastic as adjacent, relatively thicker areas. The resulting knit/weld lines formed axially in the vent locations will naturally have reduced strength, and significantly contribute to typical closure impact failures. Again, the reduction in the depth of vent passages can be achieved by the provision of rotation-inhibiting projections in accordance with the present invention.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A closure, comprising:

a closure cap including a top wall portion, and a cylindrical skirt portion depending from said top wall portion, said cylindrical skirt portion including an internal thread formation extending circumferentially of said closure at least 360°, said thread formation including a thread start at an end of said thread formation spaced furthest from said top wall portion, and a plurality of rotation-inhibiting projections provided on the inside surface of said skirt portion adjacent said thread formation for engagement with a mating thread formation on an associated container;

a primary one of said rotation-inhibiting projections being spaced from said thread start between about 20° and 40° relative to the circumference of said closure, said primary projection being positioned in most closely spaced relation to said thread start, whereby said primary projection is the first one of said rotation-inhibiting projections to engage an associated container thread, said primary projection being asymmetrically configured relative to a radius of said closure through the primary projection;

said closure including at least one secondary rotation-inhibiting projection positioned symmetrically with respect to a portion of said closure diametrically opposite of said primary projection, said secondary projection being spaced from said primary projection at least about 140° circumferentially of said closure.

2. A closure in accordance with claim 1, wherein:

said closure includes a pair of said secondary projections being positioned symmetrically with respect to said diametrically opposite portion of said closure.

3. A closure in accordance with claim 2, wherein:

said secondary projections are each positioned between about 20° and 40° relative said diametrically opposite portion of said closure.

4. A closure, comprising:

a closure cap including a top wall portion, and a cylindrical skirt portion depending from said top wall portion, said cylindrical skirt portion including an internal thread formation extending circumferentially of said closure at least 360°, said thread formation including a thread start at an end of said thread formation spaced furthest from said top wall portion, and a plurality of rotation-inhibiting projections provided on the inside surface of said skirt portion adjacent said thread formation for engagement with a mating thread formation on an associated container;

a primary one of said rotation-inhibiting projections being spaced from said thread start between about 20° and 40° relative to the circumference of said closure;

said closure including at least one secondary rotation-inhibiting projection positioned symmetrically with respect to a portion of said closure diametrically opposite of said primary projection, said primary projection defining an interference surface oriented in a direction of said thread formation away from said thread start, said interference surface being oriented at an angle between about 0° and 45° relative to a radius of said closure through said primary projection.

5. A closure in accordance with claim 4, wherein:

said primary projection defines a guide surface oriented in a direction of said thread formation toward said thread start, said guide surface being oriented at an angle relative to said radius greater than said angle at which said interference surface is oriented.

6. A closure in accordance with claim 4, wherein:

said interference surface is oriented at an angle between about 25° and 35° relative to said radius of said closure.

7. A closure for a container, comprising:

a closure cap including a top wall portion, and a cylindrical skirt portion depending from said top wall portion, said cylindrical skirt portion including an internal thread formation extending circumferentially of said closure, said thread formation including a thread start at an end of said thread formation spaced furthest from said top wall portion, and at least one rotation-inhibiting projection positioned adjacent said thread formation in circumferentially spaced relationship to said thread start, said projection being asymmetrically configured relative to a radius of said closure through said projection to thereby define a guide surface oriented in a direction of said thread formation toward said thread start, and an interference surface oriented in a direction of said thread formation away from said thread start, said projection being spaced from said thread start between about 20° and 40° relative to the circumference of said closure.

8. A closure in accordance with claim 7, wherein:

said projection has a radial dimension between about 0.020 inches and 0.040 inches.

9. A closure for a container, comprising:

a closure cap including a top wall portion, and a cylindrical skirt portion depending from said top wall portion, said cylindrical skirt portion including an internal thread formation extending circumferentially of said closure, said thread formation including a thread start at and end of said thread formation spaced furthest from said top wall portion, and at least one rotation-inhibiting projection positioned adjacent said thread formation in circumferentially spaced relationship to said thread start, said projection being asymmetrically configured relative to a radius of said closure through said projection to thereby define a guide surface oriented in a direction of said thread formation toward said thread start, and an interference surface oriented in a direction of said thread formation away from said thread start, said projection further defining an inwardly facing surface positioned between said guide surface and said interference surface.

10. A closure in accordance with claim 9, wherein:

said guide surface and said interference surface are each generally planar.

11. A closure in accordance with claim 9, wherein:

said interference surface is oriented at an angle between about 0° and 45° relative to said radius.

12. A closure in accordance with claim 11, wherein:

said guide surface is oriented at an angle between about 70° and 90° relative to said radius.

13. A closure in accordance with claim 9, wherein:

said closure includes a plurality of said rotation-inhibiting projections, each of said projections being asymmetrically configured relative to a respective radius of said closure through each said projection to thereby each define a guide surface oriented in a direction of said thread formation toward said thread start, and an interference surface oriented in a direction of said thread formation away from said thread start.

14. A closure in accordance with claim 13, wherein:

one of said projections comprises a primary projection positioned along the extent of said thread formation closest to said thread start, said projections including at least one secondary projection positioned symmetrically with respect to a portion of said closure diametrically opposite of said primary projection.

15. A closure in accordance with claim 13, wherein:

each of said projections has a radial dimension less than the height of said thread formation.

16. A closure, comprising:

a closure cap including a top wall portion, and a cylindrical skirt portion depending from said top wall portion, said cylindrical skirt portion including an internal thread formation extending circumferentially of said closure at least 360°, said thread formation including a thread start at an end of said thread formation spaced furthest from said top wall portion, and a plurality of rotation-inhibiting projections provided on the inside surface of said skirt portion adjacent said thread formation for engagement with a mating thread formation on an associated container;

a primary one of said rotation-inhibiting projections being spaced from said thread start between about 20° and 40° relative to the circumference of said closure;

said closure including at least one secondary rotation-inhibiting projection positioned symmetrically with respect to a portion of said closure diametrically opposite of said primary projection, said primary projection being positioned about 30° from said thread start, said closure including a single one of said secondary projections positioned diametrically opposite of said primary projection.

17. A closure, comprising:

a closure cap including a top wall portion, and a cylindrical skirt portion depending from said top wall portion, said cylindrical skirt portion including an internal thread formation extending circumferentially of said closure at least 360°, said thread formation including a thread start at an end of said thread formation spaced furthest from said top wall portion, and a plurality of rotation-inhibiting projections provided on the inside surface of said skirt portion adjacent said thread formation for engagement with a mating thread formation on an associated container;

a primary one of said rotation-inhibiting projections being spaced from said thread start between about 20° and 40° relative to the circumference of said closure;

said closure including at least one secondary rotation-inhibiting projection positioned symmetrically with respect to a portion of said closure diametrically opposite of said primary projection, said primary projection defining a guide surface oriented in a direction of said thread formation toward said thread start, said guide surface being oriented at an angle between about 70° and 90° relative to a radius of said closure through said primary projection.

18. A closure package comprising:

a container having a plurality of vent grooves; and a closure comprising a closure cap including a top wall portion, and a cylindrical skirt portion depending from said top wall portion, said cylindrical skirt portion including an internal thread formation extending circumferentially of said closure, said thread formation including a thread start at an end of said thread formation spaced furthest from said top wall portion, and at least one rotation-inhibiting projection positioned adjacent said thread formation in circumferentially spaced relationship to said thread start, said projection being asymmetrically configured relative to a radius of said closure through said projection to thereby define a guide surface oriented in a direction of said thread formation toward said thread start, and an interference surface oriented in a direction away from said thread start, said interference surface being positioned for engagement with the vent grooves of said container, said interference surface being defined by angle an angle between about 0° and 45° relative to a radius of the closure through the said rotation-inhibiting projection.

19. A closure package, comprising:

a container having a plurality of vent grooves; and a closure including a closure cap having a top wall portion, and a cylindrical skirt portion depending from said top wall portion, said cylindrical skirt portion including an internal thread formation extending circumferentially of said closure more than 360° to thereby at least partially overlap itself, and projection means including at least one projection positioned between overlapping portions of said thread formation, said projection means presenting an interference surface for engagement with the vent grooves of the container, said interference surface being defined by an angle between about 25° and 35° relative to a radius of the closure through said projection means.

20. A package in accordance with claim 19, wherein:

said projection is asymmetrically configured relative to a radius of said closure through said projection means.

21. A package in accordance with claim 19, wherein:

said projection means comprises a primary projection spaced between about 20° and 40° from a thread start of said thread formation spaced furthest from said top wall portion;

said projection means further comprising a secondary projection spaced between about 180° and 240° from said thread start.

22. A package in accordance with claim 21, wherein: said projection means further comprise another secondary projection spaced no further than about 250° from the thread start.

* * * * *